US006868833B2

(12) United States Patent
Friedrich et al.

(10) Patent No.: US 6,868,833 B2
(45) Date of Patent: Mar. 22, 2005

(54) METHOD FOR DEFINING THE INJECTION TIME IN AN INJECTION SYSTEM FOR AN INTERNAL COMBUSTION ENGINE

(75) Inventors: Arno Friedrich, Regensburg (DE); Uwe Lingener, Magdebrug (DE)

(73) Assignee: Siemens Aktiengesellschaft, Munich (DE)

( * ) Notice: Subject to any disclaimer, the term of this patent is extended or adjusted under 35 U.S.C. 154(b) by 50 days.

(21) Appl. No.: 10/379,038

(22) Filed: Mar. 4, 2003

(65) Prior Publication Data

US 2003/0196643 A1 Oct. 23, 2003

Related U.S. Application Data

(63) Continuation of application No. PCT/DE01/03355, filed on Sep. 3, 2001.

(30) Foreign Application Priority Data

Sep. 5, 2000 (DE) ..... 100 43 756

(51) Int. Cl.[7] ..... F02M 51/00
(52) U.S. Cl. ..... 123/479; 123/436; 73/116
(58) Field of Search ..... 123/478, 479, 123/480, 436, 501, 502; 73/116, 118.1

(56) References Cited

U.S. PATENT DOCUMENTS 4,495,924 A * 1/1985 Ueno et al. ..... 123/478
5,699,771 A 12/1997 Tanabe ..... 123/479
5,749,222 A * 5/1998 Nakajima et al. ..... 60/274
5,871,002 A * 2/1999 Nada ..... 123/609
6,109,225 A * 8/2000 Ogita et al. ..... 123/90.15
6,467,458 B1 * 10/2002 Suzuki et al. ..... 123/491
6,499,342 B1 * 12/2002 Gonzales, Jr. ..... 73/117.3
6,671,565 B1 * 12/2003 Kobayashi ..... 700/75

FOREIGN PATENT DOCUMENTS

| | | |
|---|---|---|
| DE | 33 07 833 A1 | 8/1984 |
| DE | 42 29 773 A1 | 3/1994 |
| DE | 44 18 577 A1 | 11/1995 |
| DE | 44 18 578 A1 | 11/1995 |
| DE | 44 18 579 A1 | 11/1995 |
| EP | 0 420 288 A2 | 9/1990 |
| EP | 0 581 151 A1 | 2/1994 |
| EP | 0 942 163 A2 | 12/1998 |
| WO | 02/23031 | 3/2002 |

* cited by examiner

*Primary Examiner*—John T. Kwon
(74) *Attorney, Agent, or Firm*—Baker Botts, L.L.P.

(57) ABSTRACT

The invention relates to a method for determining the injection time of the injection system of an internal combustion engine, comprising the following steps: detecting a crankshaft signal that indicates the relative position of the crankshaft, determining the injection time on the basis of said crankshaft signal, detecting the phase angle of the crankshaft, synchronizing the calculated injection time on the basis of the phase position of the crankshaft, said phase position of the crankshaft being determined on the basis of the crankshaft signal.

26 Claims, 3 Drawing Sheets

METHOD FOR DEFINING THE INJECTION TIME IN AN INJECTION SYSTEM FOR AN INTERNAL COMBUSTION ENGINE

CROSS-REFERENCE TO RELATED APPLICATION

This application is a continuation of co-pending International Application No. PCT/DE01/03355 filed Sep. 3, 2001, which designates the United States, and claims priority to German application number DE10043756.7 filed Sep. 5, 2000.

TECHNICAL FIELD OF THE INVENTION

The invention relates to a method for defining the injection time in an injection system for an internal combustion engine.

BACKGROUND OF THE INVENTION

In internal combustion engines with an injection system, the injection time is conventionally defined as a function of the angular position of the crankshaft. However, in a four-stroke engine injection operations for a specific combustion chamber do not take place at every revolution so that in order to define the injection time it is also necessary to know the phase angle of the crankshaft. For this reason, during the starting operation of the internal combustion engine the angular position of the camshaft is conventionally also sensed in order to derive the phase angle of the crankshaft therefrom.

However, it is a disadvantage here that when the camshaft sensor fails or has a malfunction it is not possible for the internal combustion engine to operate.

SUMMARY OF THE INVENTION

The invention is thus based on the object of providing a method for defining the injection time in an injection system for an internal combustion engine, which method permits the internal combustion engine to operate even when the camshaft sensor fails or has a malfunction.

The object is achieved by the invention, according to one embodiment, in accordance with the following steps: sensing a crankshaft signal representing the angular position of the crankshaft, determining the injection time as a function of the crankshaft signal, determining the phase angle of the crankshaft, and synchronizing the calculated injection time by of the phase angle of the crankshaft, wherein the phase angle of the crankshaft is determined as a function of the crankshaft signal.

The invention comprises the general technical teaching whereby the synchronization of the injection time determined by means of the crankshaft signal is carried out independently of the camshaft signal.

The phase angle of the crankshaft is therefore preferably determined within the scope of the invention as a function of the crankshaft signal, as will be explained in more detail below.

In the preferred embodiment, the angular position of the camshaft is additionally sensed, the camshaft signal being checked for correctness. When the camshaft signal is correct, the synchronization of the injection time which is determined as a function of the angular position of the crankshaft is then conventionally carried out as a function of the camshaft signal, whereas the synchronization of the injection time is not carried out as a function of the camshaft signal when the camshaft signal is faulty or failed.

The checking of the camshaft signal can be carried out, for example, by virtue of the fact that the time interval between the pulses of the camshaft signal is measured, a malfunction of the camshaft sensor being assumed if the pulse interval exceeds a predefined limiting value.

Furthermore, in order to check the correctness of the camshaft signal, the amplitude of the pulses of the camshaft signal can be measured, a malfunction of the camshaft sensor being assumed if the pulse amplitude drops below the predefined limiting value.

However, in the preferred embodiment of the invention, the camshaft signal is checked by determining a first rotational speed value from the camshaft signal and a second rotational speed value from the crankshaft signal, the two rotational speed values having to correspond when the rotational speed sensor and the camshaft sensor are functioning correctly. When there is a deviation between the two rotational speed values, it is therefore assumed that the camshaft signal is faulty.

The synchronization of the injection time which is determined as a function of the crankshaft signal is preferably carried out within the scope of a plurality of successive synchronization attempts. For this purpose, firstly a test value for the phase angle of the crankshaft is predefined, which test value is used to synchronize the injection time. Then, the rotational speed of the internal combustion engine is measured in order to be able to check whether the synchronization with the test value was successful. If the rotational speed rises after a synchronization attempt it is assumed that the test value correctly represents the phase angle of the crankshaft so that it is possible to continue with the normal injection operation. On the other hand, if the attempt at synchronization with the test value does not lead to a rise in the rotational speed, the test value is changed and a renewed synchronization attempt is performed in the fashion described above until a synchronization attempt is successful or an aborting operation takes place.

The test value is preferably changed by a predefined angular offset after each synchronization attempt, the angular offset being preferably calculated as a function of the number of cylinders of the internal combustion engine and the crankshaft angle as follows:

$$\text{angular offset} = \frac{720^\circ \text{ crankshaft angle}}{\text{number of cylinders}}$$

On the other hand, if the crankshaft geometry is asymmetrical, the angular offset must be correspondingly adapted.

Furthermore, it is to be noted that the rotational speed of the internal combustion engine is preferably not measured directly after a synchronization attempt but rather preferably only after a predefined number of revolutions of the crankshaft or of the camshaft, or after a predefined waiting time, in order to wait for the internal combustion engine to respond to the test value.

In the preferred embodiment of the invention, the synchronization attempts are aborted after a predefined maximum synchronization period and/or after a predefined number of synchronization attempts in order to protect the internal combustion engine.

BRIEF DESCRIPTION OF THE FIGURES

Other advantageous developments of the invention are characterized in the subclaims or are explained in more detail below together with the description of the preferred exemplary embodiment of the invention by reference to the figures, of which:

DETAILED DESCRIPTION OF THE PREFERRED EMBODIMENTS

Figure 1:
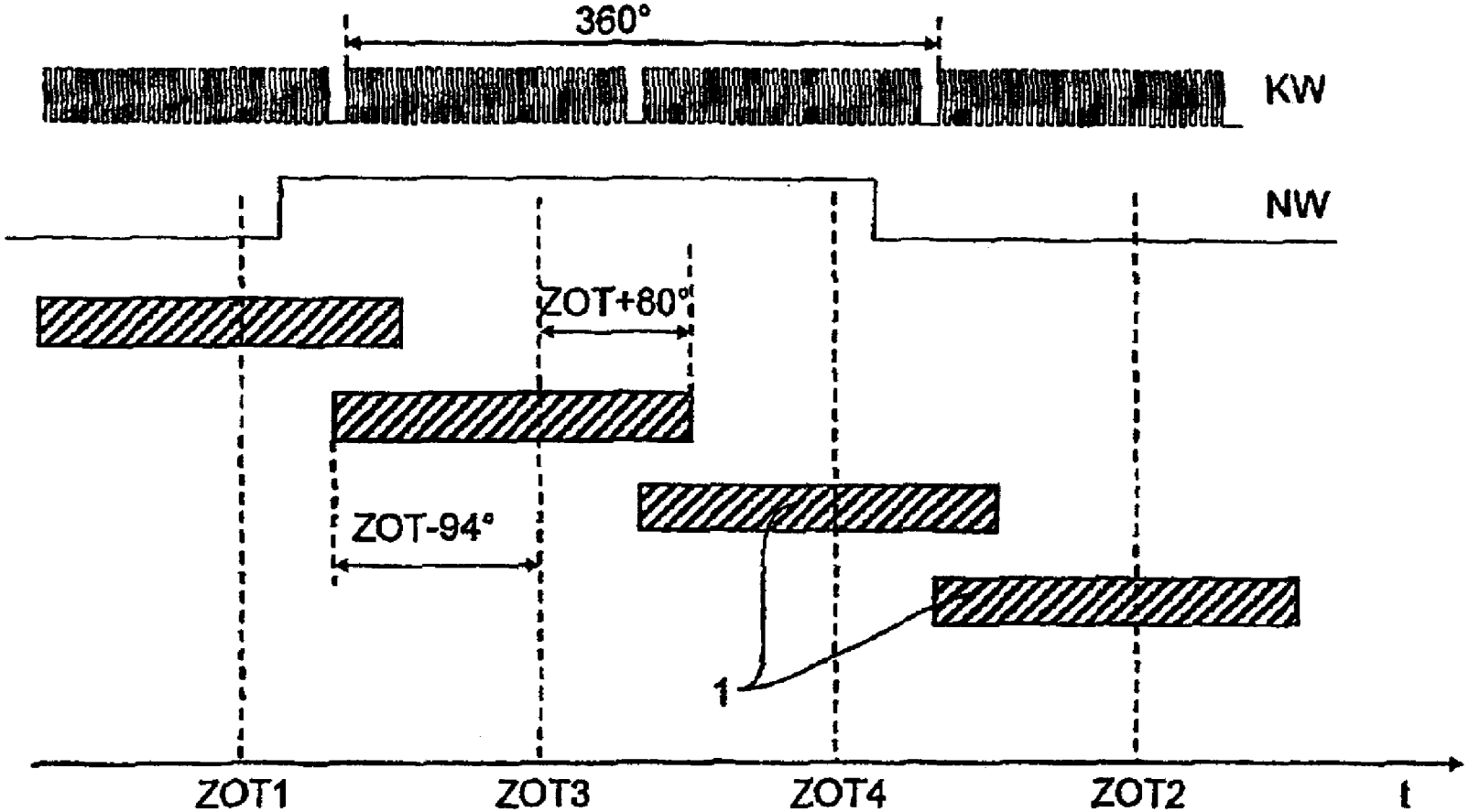
FIG. 1 is a time diagram explaining the injection times.

The time diagram illustrated in FIG. 1 shows the crankshaft signal KW which is generated by a crankshaft sensor, the crankshaft sensor having a sensor wheel with a pitch of 60 teeth and two symmetrically arranged gaps which each extend over two teeth. When there is one complete revolution of the crankshaft, two blocks of 28 pulses each are therefore generated, said pulses being each separated from one another by a gap.

Furthermore, the time diagram shows the camshaft signal NW that is generated by a separate camshaft sensor, the camshaft sensor having a sensor wheel with two circular segments of 180° each.

In addition the time diagram shows the ignition times ZOT1–ZOT4 for the individual combustion chambers of the internal combustion engine and the technically suitable bandwidths 1 of the injection time within which it is appropriate for the internal combustion engine to operate.

Figure 2A:
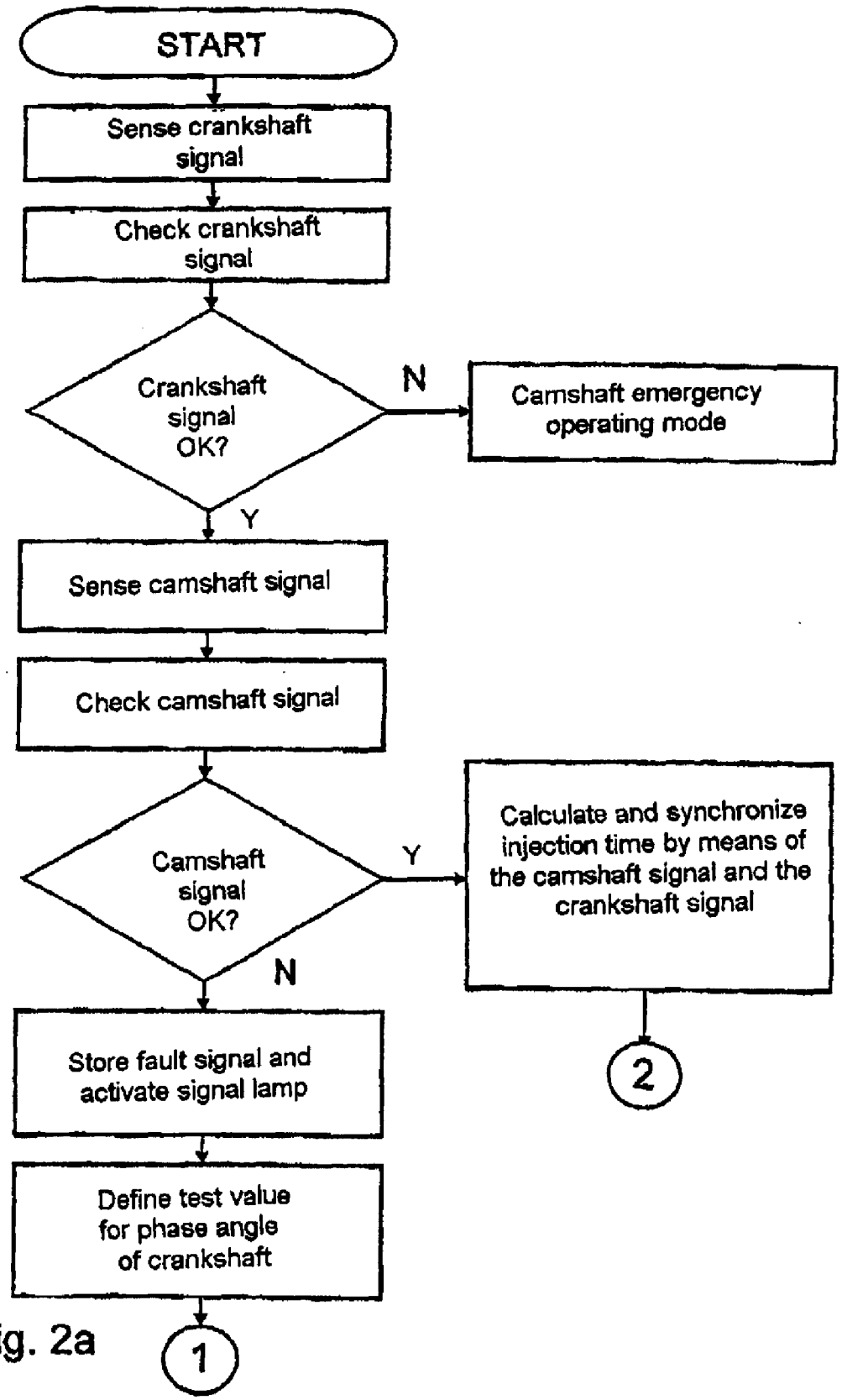
FIGS. 2*a* and 2*b* show the method according to the invention as a flowchart.
Figure 2B:
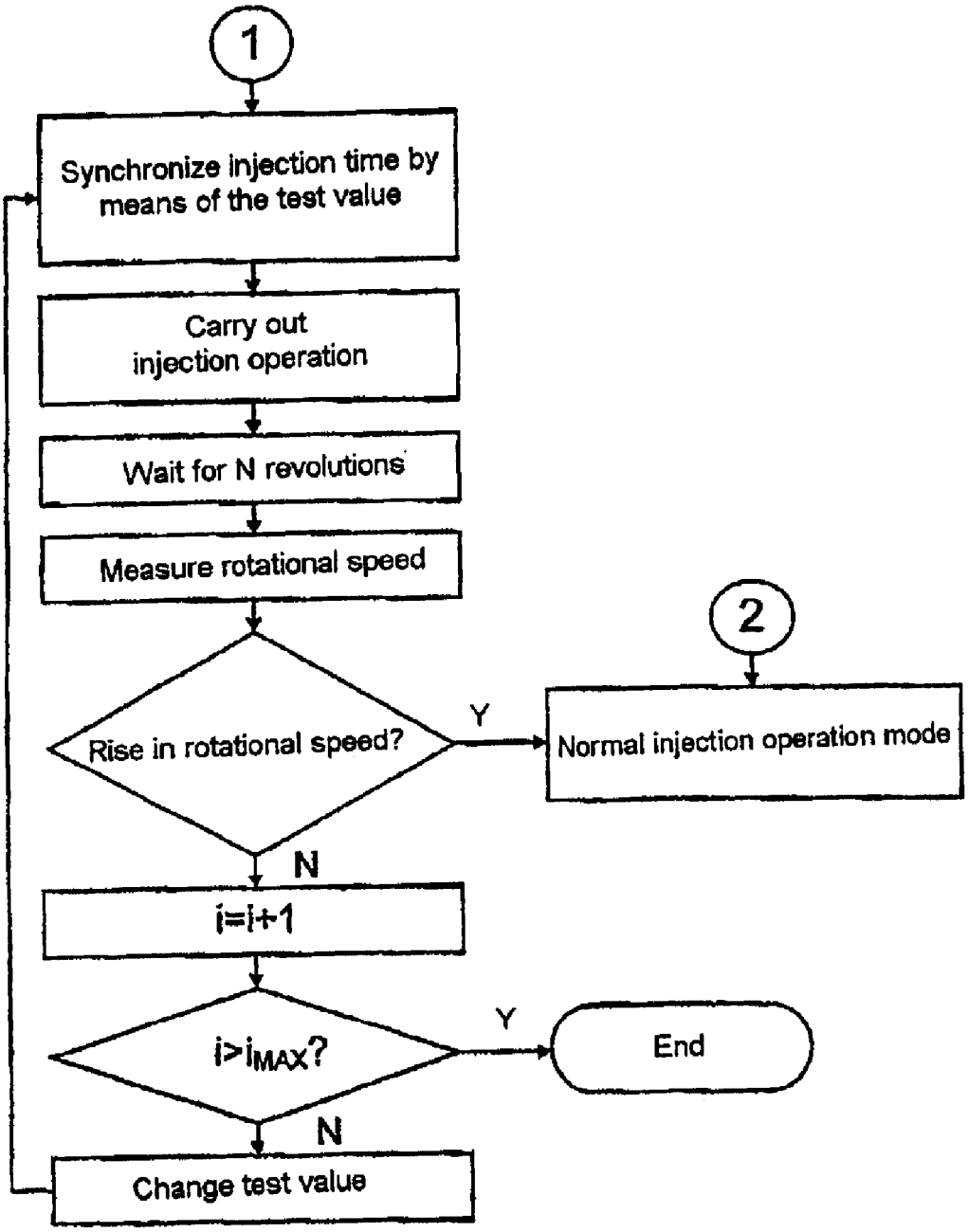

The method according to the invention will now be explained below with reference to the flowcharts illustrated in FIG. 2*a* and FIG. 2*b*.

At the beginning, the crankshaft signal is firstly sensed and checked. When the crankshaft signal is faulty, a camshaft emergency operation then takes place, whereas when the crankshaft signal is correct, the camshaft signal is also sensed and checked.

For this purpose, the time interval between the pulses of the camshaft signal is measured, a malfunction of the camshaft sensor being assumed if the pulse interval exceeds a predefined limiting value.

As an alternative to this, the camshaft signal can also be checked by measuring the amplitude of the pulses of the camshaft signal, a malfunction of the camshaft sensor being assumed if the amplitude of the pulses drops below a predefined limiting value.

Finally, it is also possible to measure the edge intervals of the camshaft signal and of the crankshaft signal in order to check the camshaft signal.

However, the camshaft signal is preferably checked by calculating a rotational speed value both from the camshaft signal and from the crankshaft signal, the two rotational speed values having to correspond when the camshaft sensor and the crankshaft sensor are functioning correctly. When there is a deviation between the two rotational speed values which are calculated in this way, it is therefore possible to assume that the camshaft sensor is faulty.

When the camshaft signal is correct, the injection time is calculated and synchronized by means of the crankshaft signal and the camshaft signal.

On the other hand, when the camshaft signal is faulty, firstly a fault signal is stored and if appropriate a signal lamp is actuated in order to signal the malfunction of the camshaft sensor.

Furthermore, in this case, a test value for the phase angle of the crankshaft is defined in order to synchronize the previously calculated injection time by means of this test value.

Then, an injection process is performed at the injection time determined in this way, in order to be able to check whether the test value represents the phase angle of the crankshaft correctly. While the injection process is being carried out, the system initially waits for a predefined number N of revolutions and the rotational speed is measured.

If the test value correctly represents the phase angle of the crankshaft, the internal combustion engine reacts to the injection operation with a rise in rotational speed. In this case, the test value is transferred and the system continues with the normal injection operation.

However, otherwise a counter i which represents the number of synchronization attempts is incremented, the counter i being compared with a predefined limiting value $i_{max}$. If the number i of synchronization attempts exceeds the predefined limiting value $i_{max}$, the synchronization attempts are aborted in order to protect the internal combustion engine.

On the other hand, a new test value for the phase angle of the internal combustion engine is otherwise calculated and the injection time is synchronized by means of this test value. This cycle is run through until either the predefined maximum number of synchronization attempts has been exceeded or a rise in rotational speed is sensed. The test value for the phase angle of the crankshaft is changed here between the individual synchronization attempts, in each case by a predefined angular offset, the angular offset being calculated according to the following formula:

$$\text{angular offset} = \frac{720^\circ \text{ crankshaft angle}}{\text{number of cylinders}}$$

The invention is not restricted to the preferred exemplary embodiment described above. Instead, a multiplicity of variants and modifications which make use of the inventive idea and therefore also fall within the scope of protection are conceivable.

What is claimed is:

1. A method for defining the injection time in an injection system for an internal combustion engine, said method comprising:

sensing a crankshaft signal representing the angular position of the crankshaft, determining the injection time as a function of the crankshaft signal, determining the phase angle of the crankshaft, sensing a camshaft signal representing the angular position of a camshaft, checking the camshaft signal for correctness, synchronizing the calculated injection time using the camshaft signal, if the camshaft signal is correct, wherein the correctness of the camshaft signal is checked via one of the checks selected from the group consisting of (i), (ii), and (iii), (i) the time interval between the pulses of the camshaft signal is determined, (ii) the amplitude of the pulses of the camshaft signal is sensed and compared with a reference value, (iii) a first rotational speed value is determined from the camshaft signal and a second rotational speed value is determined from the crankshaft signal, the two rotational speed values being compared with one another in order to check the correctness of the camshaft signal, if the camshaft signal is incorrect, synchronizing the calculated injection time using the phase angle of the crankshaft, wherein the phase angle of the crankshaft is determined as a function of the crankshaft signal.

2. The method as claimed in claim 1, further comprising:

a) defining a test value for the phase angle of the crankshaft, b) synchronizing the injection time which is calculated as a function of the crankshaft signal by means of the test value for the phase angle of the crankshaft, c) sensing the rotational speed of the internal combustion engine, d) changing the test value for the phase angle of the crankshaft if the synchronization by means of the test value does not lead to rise in the rotational speed, e) repeating steps b) to d) until the synchronization by means of the test value leads to a rise in the rotational speed.

3. The method as claimed in claim 2, wherein the test value for the phase angle of the crankshaft is changed in each case by a predefined angular offset in a four-stroke engine.

4. The method as claimed in claim 3, wherein the angular offset is calculated as a function of the number of cylinders of the internal combustion engine and the crankshaft angle as follows:

$$\text{angular offset} = \frac{720^\circ \text{ crankshaft angle}}{\text{number of cylinders}}.$$

5. The method as claimed in claim 2, wherein the rotational speed of the internal combustion engine after a synchronization attempt is not measured until after a predefined number of revolutions of the crankshaft or of the camshaft.

6. The method as claimed in claim 2 wherein the rotational speed of the internal combustion engine after a synchronization attempt is not measured until after a predefined waiting time.

7. The method as claimed in claim 2, wherein the synchronization attempts are aborted after a predefined maximum synchronization period.

8. The method as claimed claim 2, wherein the synchronization attempts are aborted after a predefined number of synchronization attempts.

9. The method as claimed in claim 2, wherein the synchronization by means of the crankshaft signal does not take place until the checking of the camshaft signal for a predefined checking period yields a faulty camshaft signal.

10. The method as claimed in claims 2, wherein the number of revolutions of the crankshaft or of the camshaft is determined after a faulty camshaft signal is detected, the synchronization by means of the crankshaft signal not being carried out until after a predefined number of revolutions.

11. The method as claimed in claim 1, wherein an audible and/or visual signal transmitter is activated when the camshaft signal is faulty.

12. The method as claimed in claim 1, wherein a fault signal is stored when the camshaft signal is faulty.

13. A method for defining the injection time in an injection system for an internal combustion engine, said method comprising:

sensing a crankshaft signal representing the angular position of said cranshaft;

determining the injection time as a function of the crankshaft signal;

determining the phase angle of the crankshaft as a function of the crankshaft signal;

sensing a camshaft signal which represents the angular position of said am shaft;

checking the camshaft signal for correctness, synchronizing the calculated injection time, the synchronization being carried out using the camshaft signal when the camshaft signal is correct and by means of the phase angle of the crankshaft, which angle is determined from the crankshaft signal, when the camshaft signal is faulty or has failed, wherein a first rotational speed value is determined from the camshaft signal and a second rotational speed value is determined from the crankshaft signal, the two rotational speed values being compared with one another in order to check the correctness of the camshaft signal.

14. The method as claimed in claim 13, wherein to check the correctness of the camshaft signal, the time interval between the pulses of the shaft signal is determined.

15. The method as claimed in claim 1, wherein to check the correctness of the camshaft signal, the amplitude of the pulses of the camshaft signal is sensed and compared with a reference value.

16. The method as claimed in claim 13, further comprising:

a) defining a test value for the phase angle of the crankshaft;

b) synchronizing the injection time calculated as a function of the crankshaft signal using the test value for the phase angle of the crankshaft;

c) sensing the rotational speed of the internal combustion engine;

d) changing the test value for the phase angle of the crankshaft if the synchronization does not lead to a rise in the rotational speed;

e) repeating steps b) to d) until the synchronization leads to a rise in the rotational speed.

17. The method as claimed in claim 16, wherein the test value for the phase angle of the crankshaft is changed in each case by a predefined angular offset in a four-stroke engine.

18. The method as claimed in claim 17, wherein the angular offset is calculated as a function of the number of cylinders of the internal combustion engine and the crankshaft angle as follows:

$$\text{angular offset} = \frac{720^\circ \text{ crankshaft angle}}{\text{number of cylinders}}.$$

19. The method as claimed in claim 16, wherein the rotational speed of the internal combustion engine after a synchronization attempt using the test value is not measured until after a predefined number of revolutions of the crankshaft or of the camshaft.

20. The method as claimed claims 16, wherein the rotational speed of the internal combustion engine after a synchronization attempt using the test value is not measured until after a predefined waiting time.

21. The method as claimed in claim 16, wherein the synchronization attempts using the test value are aborted after a predefined maximum synchronization period.

22. The method as claimed in claim 16, wherein the synchronization attempts using the test value are aborted after a predefined number of synchronization attempts.

23. The method as claimed in claim 16, wherein the synchronization by means of the crankshaft signal does not take place until the checking of the camshaft signal for a predefined checking period yields a faulty camshaft signal.

24. The method as claimed in claim 16, wherein the number of revolutions of the crankshaft or of the camshaft is determined after a faulty camshaft signal is detected, the synchronization by means of the crankshaft signal not being carried out until after a predefined number of revolutions.

25. The method as claimed in claim 13, wherein an audible and/or visual signal transmitter is activated when the camshaft signal is faulty.

26. The method as claimed in claim 13, wherein a fault signal is stored when the camshaft signal is faulty.

* * * * *